United States Patent [19]

Mutschler

[11] 4,390,299

[45] Jun. 28, 1983

[54] INDIA INK DRAWING IMPLEMENT

[76] Inventor: Otto Mutschler, Rudolf-Krehl-Strasse 21, Heidelberg, D-6900, Fed. Rep. of Germany

[21] Appl. No.: 297,739

[22] Filed: Aug. 31, 1981

[30] Foreign Application Priority Data

Oct. 2, 1980 [DE] Fed. Rep. of Germany ..... 3037257

[51] Int. Cl.[3] ..... B43K 5/16; B43K 1/06; B43K 1/10

[52] U.S. Cl. ..... 401/258; 401/259

[58] Field of Search ..... 401/258, 259, 260

[56] References Cited

U.S. PATENT DOCUMENTS

| | | | |
|---|---|---|---|
| 1,205,920 | 11/1916 | Miura | 401/258 |
| 2,891,512 | 6/1959 | Kovacs | 401/258 X |
| 3,424,538 | 1/1969 | Rausch | 401/259 |
| 3,442,597 | 5/1969 | Hebborn et al. | 401/259 |
| 3,938,899 | 2/1976 | Mutschler | 401/260 |

FOREIGN PATENT DOCUMENTS

| | | | |
|---|---|---|---|
| 1911951 | 9/1970 | Fed. Rep. of Germany | 401/259 |
| 2460345 | 7/1975 | Fed. Rep. of Germany | 401/258 |
| 2422137 | 11/1975 | Fed. Rep. of Germany | 401/260 |
| 657351 | 9/1951 | United Kingdom | 401/259 |

*Primary Examiner*—Steven A. Bratlie
*Attorney, Agent, or Firm*—Kurt Kelman

[57] ABSTRACT

An India ink drawing implement comprises a retaining box defining an axial bore and a tubular drawing point affixed to an outer end of the retaining box for receiving India ink from the axial bore of the retaining box. A retainer for a floating weight is threadedly fastened to a threaded inner end of the retaining box. The retainer defines an axial bore in alignment with the axial bore of the retaining box and comprises an elongated tubular portion extending through the retainer box bore and a bottom closing an inner end of the retainer. A floating weight is guided for axial movement in the axial bore of the retainer and a portion of the retaining box bore. The length of the tubular retainer portion is sufficient to guide a major portion of the floating weight and the bottom of the retainer limits the stroke of the axial movement of the floating weight.

3 Claims, 5 Drawing Figures

Figure 1:
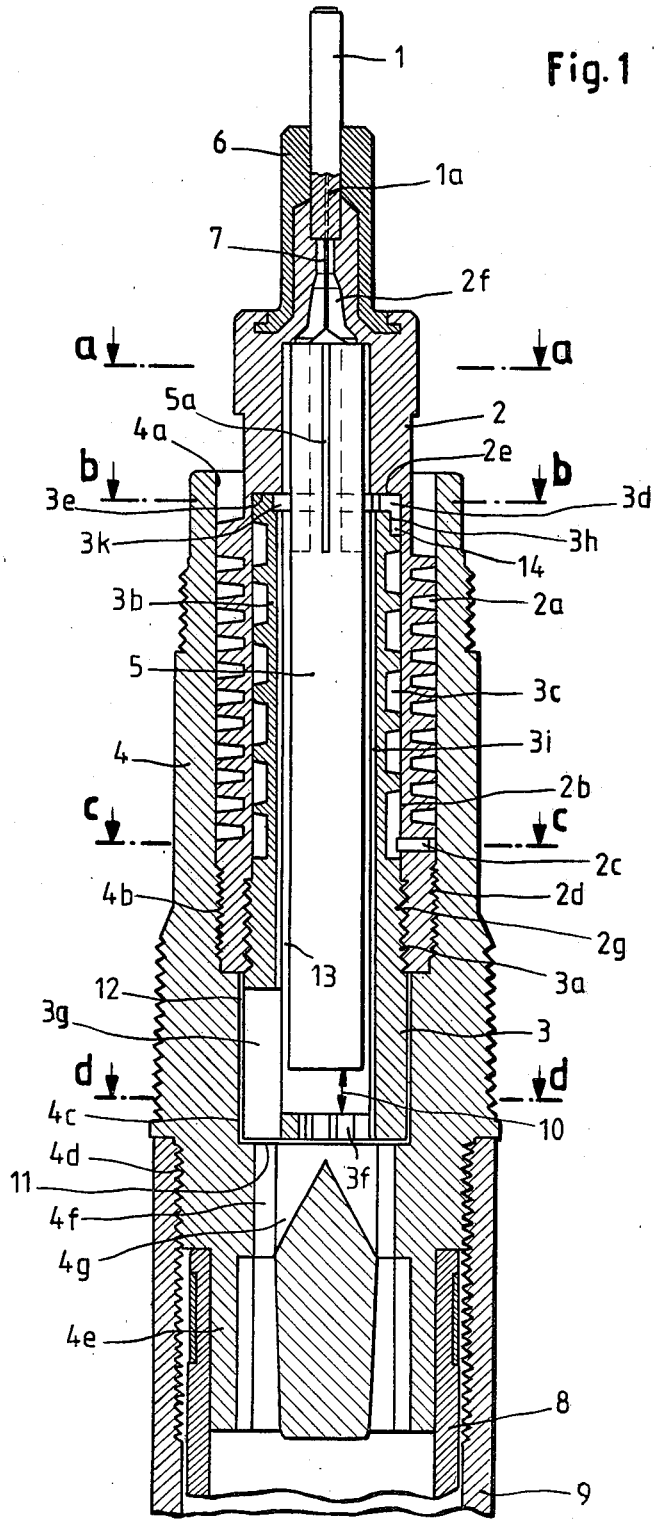

1
1a
6
7
2f
a
a
5a
4a
2
2e
b
b
3e
3d
3k
3h
14
3b
2a
5
3c
4
3i
2b
c
c
2c
4b
2d
2g
13
3a
12
3g
3
d
d
4c
10
4d
3f
11
4f
4g
4e
8
9

INDIA INK DRAWING IMPLEMENT

The present invention relates to an India ink drawing implement comprising a retaining box having an outer end and an interiorly threaded inner end, the retaining box defining an axial bore, a tubular drawing point affixed to the outer end of the retaining box for receiving India ink from the axial bore of the retaining box and a retainer for a floating weight threadedly fastened to the threaded inner end of the retaining box.

It is known that the usefulness and quality of an ink writing or drawing implement primarily depend on the control of the ink flow to the writing or drawing point. Therefore, many attempts have been made to solve this problem satisfactorily. Ink flow control systems of various constructions and designs have been proposed for this purpose.

For example, Published German patent application No. 2,422,137 discloses a capillary ink flow control system in the retaining box of an India ink drawing implement. In this system, the India ink reservoir is connected to the outer end of the retaining box by a capillary field which spans the stroke of the axial movement of a floating weight arranged in the system. In commercial practice, this system has not produced satisfactory results.

It is the primary object of this invention to increase the capacity of the ink flow control system of otherwise conventional India ink drawing (or writing) implements sufficiently to enable students, apprentices and other relatively unskilled persons to use the implement without problems, i.e. to provide a well functioning ink flow control system which has a large volume and is immune to impacts and vibrations. The system is also designed to function with a half-filled cartridge under temperature variations up to about 30° without feeding ink to the outer end to form of ink droplets at the drawing point when the cap is removed from the implement. It is also necessary that the ink-filled ink collecting system of the ink flow control will always be dependably emptied in use so as to enable the ink reservoir or cartridge to be mounted in the implement without ink residues appearing at the outer end of the drawing point and smudging the paper.

The above and other objects are accomplished according to the invention in an India ink drawing implement of the first-indicated type with a retainer which defines an axial bore in axial alignment with the axial bore of the retaining box. The retainer comprises an elongated tubular portion extending through the retaining box bore and a bottom closing an inner end of the retainer. A floating weight is guided for axial movement in the axial bore of the retainer and a portion of the retaining box bore, the length of the tubular retainer portion being sufficient to guide a major portion of the floating weight and the bottom of the retainer limiting the stroke of the axial movement of the floating weight. A spiral ink collecting system preferably extends along the circumference of the tubular retainer portion.

Figure 2D:
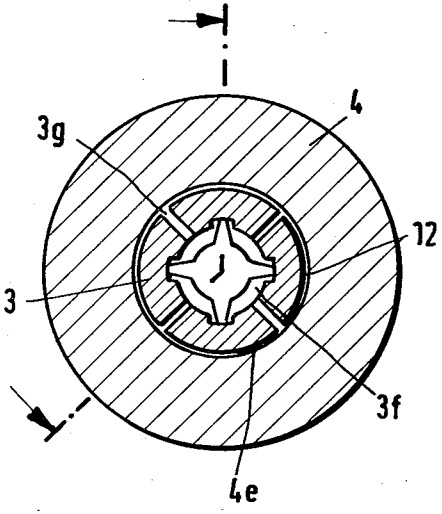
Figure 2B:
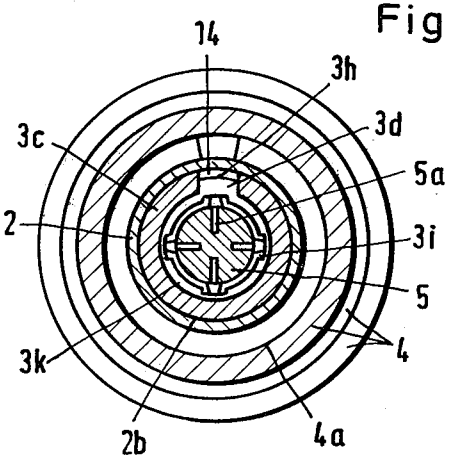
Figure 2C:
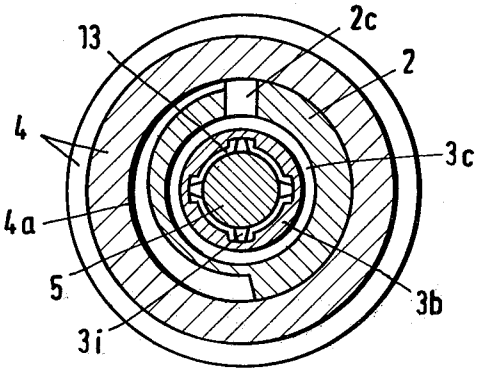
Figure 2A:
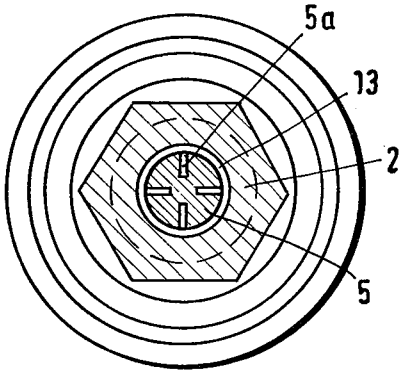

The above and other objects, advantages and features of the present invention will become more apparent from the following detailed description of a now preferred embodiment of this invention, taken in conjunction with the accompanying drawing wherein FIG. 1 shows an axial section of the front portion of an India ink drawing implement incorporating this invention and FIGS. 2*a* and 2*d* respectively illustrate transverse cross sections along lines a—a, b—b, c—c and d—d of FIG. 1.

Referring now to the drawing, there is shown an India ink drawing implement which comprises tubular retaining box 2 having an outer end and interiorly threaded inner end 2*g*. The retaining box defines axial bore 2*b*. Tubular drawing point 1 is affixed to the outer end of retaining box 2 and has axial bore 1*a* for receiving India ink from narrowed axial bore part 2*f* of the retaining box. In the illustrated embodiment, tubular drawing point holder 6 is attached to the outer end of the retaining box and the drawing point is frictionally held in the holder. In this embodiment, spiral ink collecting system 2*a* extends along a portion of the circumference of the tubular retaining box. The inner end of the retaining box also has an exterior or peripheral threaded portion which enables the retaining box to be threadedly fastened to threaded portion 4*b* of grip 4 of the implement.

Shoulder 2*e* in axial bore 2*b* of retaining box 2 separates the bore into a constricted outer portion and a larger-diameter inner portion about which ink collecting system 2*a* extends within bore 4*a* of grip 4. Tubular retainer 3 for floating weight 5 has exteriorly threaded portion 3*a* threadedly fastened to threaded inner end 2*g* of retaining box 2. Retainer 3 defines an axial bore in axial alignment with axial bore 2*b* of retaining box 2 and comprises elongated tubular portion 3*b* extending through the larger-diameter inner retainer box bore portion. Bottom 3*f* closes the inner end of retainer 3. Elongated tubular retainer portion 3*b* is received in the larger-diameter portion of the retaining box bore and extends therethrough. Spiral ink collecting system 3*c* extends along the circumference of tubular retainer portion 3*b* in axial bore 2 of the retaining box.

As is shown in FIG. 1, floating weight 5 is guided for axial movement in the axial bore of retainer 3 and the constricted outer portion of bore 2*b* of the retaining box. The length of the tubular retainer portion is sufficient to guide a major portion of the elongated floating weight, as illustrated, and bottom 3*f* of the retainer limits the stroke of the axial movement of floating weight 5, which is indicated by double-headed arrow 10. The bottom also prevents the floating weight from falling out of the retainer when retaining box 2 is screwed out of grip 4, the retaining box, retainer and floating weight constituting a detachable unit of the implement.

Spiral ink collecting system 2*a* and 3*c* are in communication at their inner ends through radial port 2*c* defined in retaining box 2. Spiral ink collecting system 3*c* is communication at its outer end with the bore of the floating weight retainer through connecting slot 3*d*. Duct 3*h* at the outer end of retainer 3 and spiral ink collecting system 3*c* defines ink flow control path 14.

The retainer bore has air conducting groove 3*i* extending along the entire length of the bore and spanning the stroke of the axial movement of floating weight 5. Air conducting groove 3*i* communicates with annular groove 3*k* at the outer end of retainer 3.

The implement holds India ink reservoir or cartridge 8 and, when in use, the ink flows from the reservoir through capillary slit 4*f* into transversely extending clearance 11 whence it flows into annular clearance 12 defined between retainer 3 and grip 4 beyond threaded connection 2*g*, 3*a* between the retainer and retaining box 2. Radially extending capillary slits 3*g* in retainer 3 permit the ink to flow from clearance 12 into annular clearance 13 which surrounds floating weight 5. The outer end of the floating weight defines a plurality of radially extending elongated capillary grooves 5*a* in communication with annular clearance 13 so that the ink continues flowing from this clearance through the capillary grooves into portion 2*f* of the retaining box bore. The floating weight carries wire 7 projecting into axial bore 1*a* of drawing point 1 to carry the ink to the drawing point. At the same time, the ink flows from annular clearance 13 through connecting slot 3*d* in annular outer end 3*e* of retainer 3 into capillary control path 14 defined by duct 3*h* at the outer end of spiral ink collecting system 3*c* and bore 2*b* of the retaining box, thus closing the ink flow path against entry of air.

As India ink is used up in the course of drawing with the implement, a vacuum is created in ink reservoir 8 and the flow path of the ink. This vacuum causes the ink to be sucked out of control path 14. This opens the ink flow path to the entry of air trapped in spiral system 3*c*, which communicates with the control path and thus delivers air bubbles through connecting slot 3*d* and annular groove 3*k* into air conducting capillary grooves 3*i*. The air bubbles move along floating weight 5 and out of the retainer through ports in retainer bottom 3*f* to enter air conducting grooves 4*g* in communication with ink reservoir 8. Thus, air entering collecting or trapping systems 2*a* and 3*c* from the atmosphere assures a pressure equilibrium between the atmospheric pressure and the pressure prevailing in ink reservoir 8. It is important to dimension air conducting groove 3*i* sufficiently large so that the free flow of ink is not interrupted by an excessive vacuum in the ink flow control system when the ink flow is considerable due to rapid drawing with the implement. A larger air conducting groove assures a rapid restoration of the pressure equilibrium.

When the implement is subjected to increased heat, for instance by being in the hand of a user or if subjected to solar radiation, it is important for the air trapping volume of the ink flow control system to be adapted to considerable temperature variations up to about 30°, for example. This is particularly significant for the type of use where the user carries the implement in his pocket in cold weather so that the implement becomes rather cold and its temperature is then rapidly raised during drawing. Such a rapid change in temperature may entail particularly unfavorable results if the reservoir contains relatively little ink because the volume of air to be heated is then large and a correspondingly large amount of ink is then pressed into the collecting or trapping system. As the pressure in the ink reservoir increases by heating the air therein, the pressure in the capillary air conducting system is increased correspondingly. It is important to reduce this air pressure rapidly by a sensitive control system. Otherwise, droplets of ink will form at the drawing point.

It has been found to be advantageous to effect the pressure reduction as close to the drawing point as possible. This is accomplished ideally in the illustrated embodiment wherein spiral system 3*c* on the circumference of retainer 3 is connected by connecting slot 3*d* and annular groove 3*k* with capillary annular clearance 13 defined between floating weight 5 and tubular retainer portion 3*b* as well as with air conducting capillary grooves 3*i* in retainer 3. This arrangement causes the pressure to be reduced as close to the drawing point as possible. Even a small increase in the pressure will cause control path 14 to open the way for the flow of ink flowing in spiral system 3*c*. Normally, the volume of the spiral collecting system suffices to accommodate all prevailing pressure differences. However, extreme temperature variations may cause the ink to flow through port 2*c* into spiral system 2*a* where it is safely held. In this manner, spiral systems 2*a* and 3*c* form a secure ink collecting or trapping system. These spiral ducts are so dimensioned that they are completely emptied as the pressure in ink reservoir 8 decreases and the ink is used up during drawing.

The volume of the two spiral collecting systems arranged in series is so dimensioned that the implement operates with a half-filled cartridge or ink reservoir at temperature variations of 30°. The spiral arrangement of the collecting system assures a resistance to impacts or vibrations not heretofore obtained. This is of particular importance in such a system because impacts or vibrations will cause floating weight 5 to be axially moved so that bore 1*a* of drawing point 1 may be cleaned by the movement of floating weight wire 7 therethrough. The reciprocating wire movement will remove ink encrustations from bore 1*a*.

The improved structure hereinabove described has particularly noticeable advantages when the ink cartridge is replaced because no ink residues will be found between grip 4 and retaining box 2. The cartridge is held in tubular body 9 of the drawing implement and skirt 4*e* of grip 4 extends into the tubular body for holding the cartridge in position.

What is claimed is:

1. An India ink drawing implement comprising:

(a) a retaining box having an outer end and an inner end, the retaining box having a circumference and defining an axial bore and a shoulder in the axial bore, the retaining box comprising (1) a spiral ink collecting system extending along the circumference of the retaining box, (b) a retainer tube for a floating weight defining an axial bore in axial alignment with the axial bore of the retaining box, the retainer tube comprising (1) an elongated tubular portion having a circumference and extending through the retainer box bore, the tubular portion having an annular outer end engaging the shoulder and defining an annular groove and a port, (2) another spiral ink collecting system extending along the circumference of the tubular portion, the ink collecting systems being connected by another port at an inner end thereof and the other ink collecting system having an outer end at the shoulder, the shoulder and the axial bore of the retaining box forming a duct defining an ink flow control path connected to the annular groove by the port in the outer end of the tubular portion, and (c) a floating weight guided for axial movement in the axial bore of the retainer tube and a portion of the retaining box bore, the length of the tubular portion being sufficient to guide a major portion of the floating weight and the bottom of the retainer tube limiting the stroke of the axial movement of the floating weight, (1) the retainer tube bore having air conducting capillary passages spanning the stroke of the axial movement of the floating weight and in communication with the annular groove.

2. The India ink drawing implement of claim 1, wherein the floating weight has an outer end defining a plurality of elongated capillary grooves in communication with the bore of the retaining box.

3. The India ink drawing implement of claim 1, wherein the inner end of the retaining box is interiorly threaded and the retainer tube is threadedly fastened to the threaded inner end of the retaining box.

* * * * *